US005845511A

United States Patent [19]

Okada et al.

[11] Patent Number: 5,845,511

[45] Date of Patent: Dec. 8, 1998

[54] RECEIVER HAVING EXPANSION MECHANISM

[75] Inventors: Satoru Okada, Hashima; Kiyotaka Kasugai, Ogaki, both of Japan

[73] Assignee: Pacific Industrial Co., Ltd., Japan

[21] Appl. No.: 883,687

[22] Filed: Jun. 27, 1997

[30] Foreign Application Priority Data

Jun. 28, 1996 [JP] Japan ..... 8-170424

[51] Int. Cl.[6] ..... F25B 41/04

[52] U.S. Cl. ..... 62/217; 62/223; 62/509

[58] Field of Search ..... 62/222, 223, 217, 62/498, 509, 475

[56] References Cited

U.S. PATENT DOCUMENTS

| | | | |
|---|---|---|---|
| 2,335,694 | 11/1943 | Paquin et al. . | |
| 3,525,234 | 8/1970 | Widdowson | 62/217 |
| 3,822,563 | 7/1974 | Orth | 62/217 |
| 3,965,693 | 6/1976 | Widdowson | 62/217 |
| 4,756,166 | 7/1988 | Tomasov | 62/509 |
| 5,454,233 | 10/1995 | Naujock | 62/509 |

*Primary Examiner*—Henry A. Bennett
*Assistant Examiner*—Susanne C. Tinker
*Attorney, Agent, or Firm*—Fish & Richardson P.C.

[57] ABSTRACT

A receiver is located in a refrigerating circuit that includes a compressor, a condenser, an expansion valve and an evaporator. The receiver receives and temporarily reserves liquefied refrigerant sent from the compressor by way of the condenser. The expansion valve atomizes the liquefied refrigerant sent from the receiver and supplies the atomized refrigerant to the evaporator. The receiver includes a tank for reserving the liquefied refrigerant sent from the condenser and a head portion located on the tank. The head portion houses the expansion valve. The expansion valve includes a restricting mechanism for adjusting the flow rate of the refrigerant supplied to the evaporator from the tank and a control mechanism for controlling the restricting mechanism in accordance with the temperature of the refrigerant transferred to the compressor from the evaporator.

21 Claims, 19 Drawing Sheets

RECEIVER HAVING EXPANSION MECHANISM

BACKGROUND OF THE INVENTION

1. Field of the Invention

The present invention relates to a receiver incorporated in a refrigeration circuit of a vehicle air conditioner.

2. Description of the Related Art

FIG. 16 illustrates a known refrigeration circuit of a vehicle air conditioner. The circuit includes a compressor 121, a condenser 122, a receiver 123, an expansion valve 124, an evaporator 125 and pipes 126 for connecting the devices. The compressor 121 compresses refrigerant and sends the compressed refrigerant to the other devices. After passing through the devices, the refrigerant returns to the compressor 121.

A first charging valve 127 and a relief valve 128 are provided in a pipe 126 that is connected to the outlet port of the compressor 121. A second charging valve 129 is provided in another pipe 126 that is connected to the inlet port of the compressor 121. A pressure switch 130 and a sight glass 131 are provided in yet another pipe 126 that connects the condenser 122 and the receiver 123.

The expansion valve 124 expands high temperature, high pressure liquefied refrigerant thereby atomizing the refrigerant into low temperature, low pressure refrigerant mist. The valve includes a casing 135, in, which a first passage 136, a second passage 137 and a third passage 138 are defined. A restricting mechanism 139 is provided in the inner portion of the first passage 136. The mechanism 139 includes a valve chamber 140, an orifice 141, a valve body 143 and a spring 144. The orifice 141 communicates the valve chamber 140 with the second passage 137. A valve seat 142 is defined on the area surrounding then orifice 141. The valve body 143 is provided in the chamber 140 facing the valve seat 142 and is urged toward the valve seat 142 by the spring 144.

A pressure chamber 145 is defined in the upper portion of the casing 135 and is communicated with the third passage 138. A controlling mechanism 146 is screwed to the pressure chamber 146 with a packing 147 in between. The control mechanism includes a first lid 148, a second lid 149, and a diaphragm 150 retained between the lids 148, 149. The first lid 148 has an opening 152 formed in the top portion. A heat detecting chamber 151 is defined between the first lid 148 and the diaphragm 150. Saturated gas is charged in the chamber 151 through the opening 152 and is retained in the chamber 151 by sealing the opening 152 by a ball 153.

A heat detecting rod 154 is movably housed in the third passage 138. The rod 154 is made of a material having high heat conductivity such as aluminum and is provided with a flange 155 formed on one end. The flange 155 is attached to the diaphragm 150. An actuating rod 156 extends along the center of the casing 135 between the detecting rod 154 and the valve body 143. Heat is readily transferred between the refrigerant passing through the third passage 138 and the saturated gas in the detecting chamber 151 through the detecting rod 154. Therefore, the saturated gas in the detecting chamber 151 expands or contracts in accordance with the temperature of the refrigerant gas passing through the third passage 138. The pressure inside the detecting chamber 151 is changed by the expansion or contraction of the saturated gas. The diaphragm 150 is displaced upwards or downward by the pressure fluctuation in the chamber 151. The movement of the diaphragm 150 is transmitted to the valve body 143 through the heat detecting rod 154 and the actuating rod 156. As a result the opening of the orifice 141 is controlled.

As shown in FIG. 17, the receiver 123 includes a tank 160 with an open upper end and is provided with a filter 161 located at its middle portion. The filter 161 includes desiccant 162, a pair of filter members 163, 164, and a cylindrical container 165. The desiccant 162 removes moisture from the refrigerant, while the filter members 163, 164 remove particulate matter from the refrigerant. The desiccant 162 and the filters 163, 164 are accommodated in the container 165, which is meshed or has small holes formed therein.

A head portion 166 is fitted to the open end of the tank 160. The head portion 166 has an inlet port 168 and an outlet port 170 defined therein. The inlet port 168 is connected to the condenser 122 by an inlet duct 167. The outlet port 170 is connected to the first passage 136 of the expansion valve 124 by an outlet duct 169. A refrigerant pipe 171 is provided in the tank 160 and attached to the cap 166. The pipe 171 is communicated with the outlet port 170 and extends vertically through the filter 161. The lower end of the pipe 171 is located in the vicinity of the bottom of the tank 160. A stopper 172 is formed on the periphery of the middle portion of the pipe 171. The stopper 172, together with a snap ring 173, retains the filter 161 at the middle portion of the pipe 171.

Liquified refrigerant enters the tank 160 from the inlet duct 167 through the inlet port 168 and then passes through the filter 161. Thereafter, the refrigerant reaches the bottom of the tank 160, where it is temporarily stored. The stored refrigerant is drawn into the pipe 171 from its bottom opening and is then sent to the first passage 136 of the expansion valve 122 from the outlet port 170 through the outlet duct 169.

As shown in FIG. 18, the first and second charging valves 127, 129 include a valve stem 177 and a valve core 178 threaded into the center of the stem 177. A threaded outer surface 183 is defined on the periphery of the stem 177. Each of the valves 127, 129 is fixed to the corresponding pipe 126 with the lower end of the stem 177 secured to the pipe 126. The valve core 178 includes a cylinder 179. A shaft 180 is movably supported in the center portion of the cylinder 179. A packing 181 is attached to the lower portion of the shaft 180 and faces the lower opening of the cylinder 179. The shaft 180 is urged upward by a spring 182. This causes the packing 181 to contact the lower opening of the cylinder 179 thereby closing the opening.

When charging refrigerant in the pipes 126 of the refrigerant circuit, a jig (not shown) is screwed to the threaded surface 183 of the valve stem 177. When screwed to the stem 177, the jig moves the shaft 180 downward against the force of the spring 182. This separates the packing 181 from the lower opening of the cylinder 179 thereby opening the lower end of the cylinder 179. Thus, refrigerant is sent to the pipes 126 from the jig through the cylinder 179 of the valve core 178.

After charging the refrigerant, each jig is dislocated from the threaded portion 183 of the valve system 177. Then, the force of the spring 182 moves the shaft 180 upward thereby allowing the packing 181 to contact the lower opening of the cylinder 179. This shuts the lower opening of the cylinder 179. A cylindrical packing 184 seals between the valve stem 177 and the cylinder 179.

As shown in FIG. 19, the relief valve 128 includes a metal casing 188 with a threaded portion 189 on the periphery of its lower portion. The valve 128 is secured to a the pipe 126 by screwing the threaded portion 189 to the pipe 126. A valve hole 191 is defined in the threaded portion 189. A valve seat 192 is formed about the upper opening of the hole 191. A valve body 190 having a polygonal cross section is movably located in the casing 188. A packing 193, which is made of elastic material, is embedded in the bottom of the valve body 190 such that it faces the valve seat 192. A plate 194, in which a hole 196 is formed, is attached to the upper opening of the casing 188. A spring 195 is provided between the plate 194 and the valve body 190 and urges the valve body 190 downward. The force of the spring 195 causes the packing 193 to contact the valve seat 192.

When the pressure in the pipe 126 that is connected to the outlet of the compressor 121 is higher than a predetermined level, the valve body 190 is moved upward against the force of the spring 195. Accordingly the packing 193 is separated from the valve seat 192. This allows the refrigerant in the pipe 126 that is connected to the outlet of the compressor 121 to be discharged to the atmosphere through the valve hole 191, the interior of the casing 188 and the hole 196. Accordingly, abnormally high pressure in the circuit is prevented.

When the pressure in the pipe 126 that is connected to the outlet of the compressor 121 is equal to or lower than the predetermined level, the force of the spring 195 moves the valve body 190 downward thereby pushing the packing 193 against the valve seat 192. This seals the valve hole 191.

In the illustrated refrigerating circuit, the receiver 123, the expansion valve 124, the first charging valve 127, the relief valve 128, the second charging valve 129, the pressure switch 130 and the sight glass 131 are constructed independently and located separately in different positions in the pipes 126. This complicates the structure of the refrigerant circuit.

Each of the above devices must be separately assembled before being installed in the circuit. This increases the manufacturing cost. The devices must be located at corresponding positions in the engine compartment of the vehicle thereby taking up large space in the compartment. Further, installing the separate devices in the pipes 126 is burdensome.

SUMMARY OF THE INVENTION

Accordingly, it is an objective of the present invention to provide a receiver that has an expansion mechanism and thereby simplifies the construction of the refrigerant circuit.

To achieve the above objective, the present invention discloses a receiver located in a refrigerating circuit that includes a compressor, a condenser, an expansion mechanism and an evaporator. The receiver receives and temporarily reserves liquefied refrigerant sent from the compressor by way of the condenser. The expansion mechanism atomizes the liquefied refrigerant sent from the receiver and supplies the atomized refrigerant to the evaporator. The receiver includes a tank for reserving the liquefied refrigerant sent from the condenser and a head portion located on the tank. The head portion houses the expansion mechanism.

Other aspects and advantages of the invention will become apparent from the following descriptions taken in conjunction with the accompanying drawings, illustrating by way of example the principals of the invention.

BRIEF DESCRIPTION OF THE DRAWINGS

The inventions together with objects and advantages thereof, may best be understood by reference to the following description of the presently preferred embodiments together with the accompanying drawings.

DETAILED DESCRIPTION OF THE PREFERRED EMBODIMENTS

A first embodiment of a receiver accordance with the present invention will now be described with reference to FIGS. 1 to 4.

Figure 1:
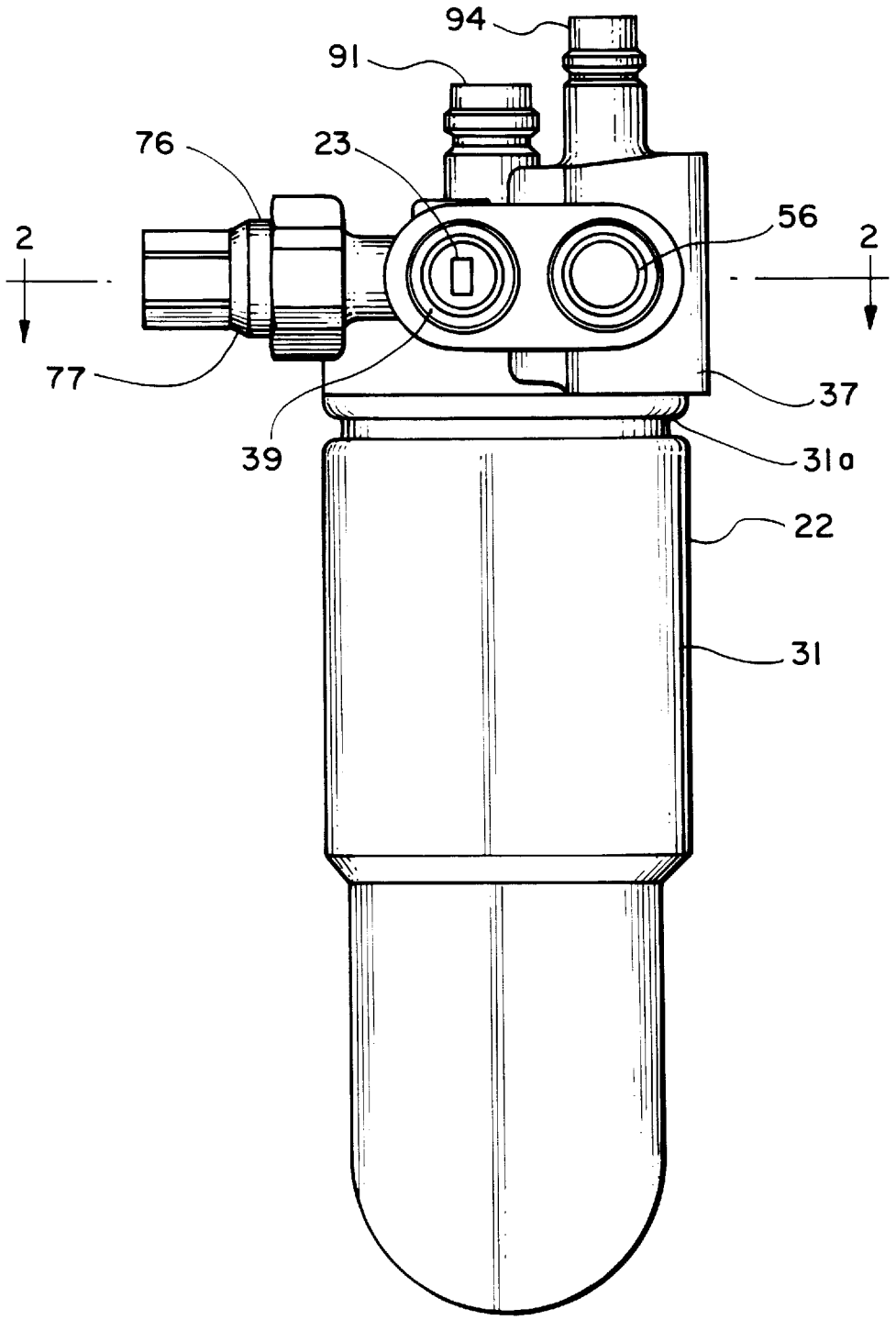
FIG. 1 is a front view illustrating a receiver having an expansion mechanism according to a first embodiment of the present invention.
Figure 2:
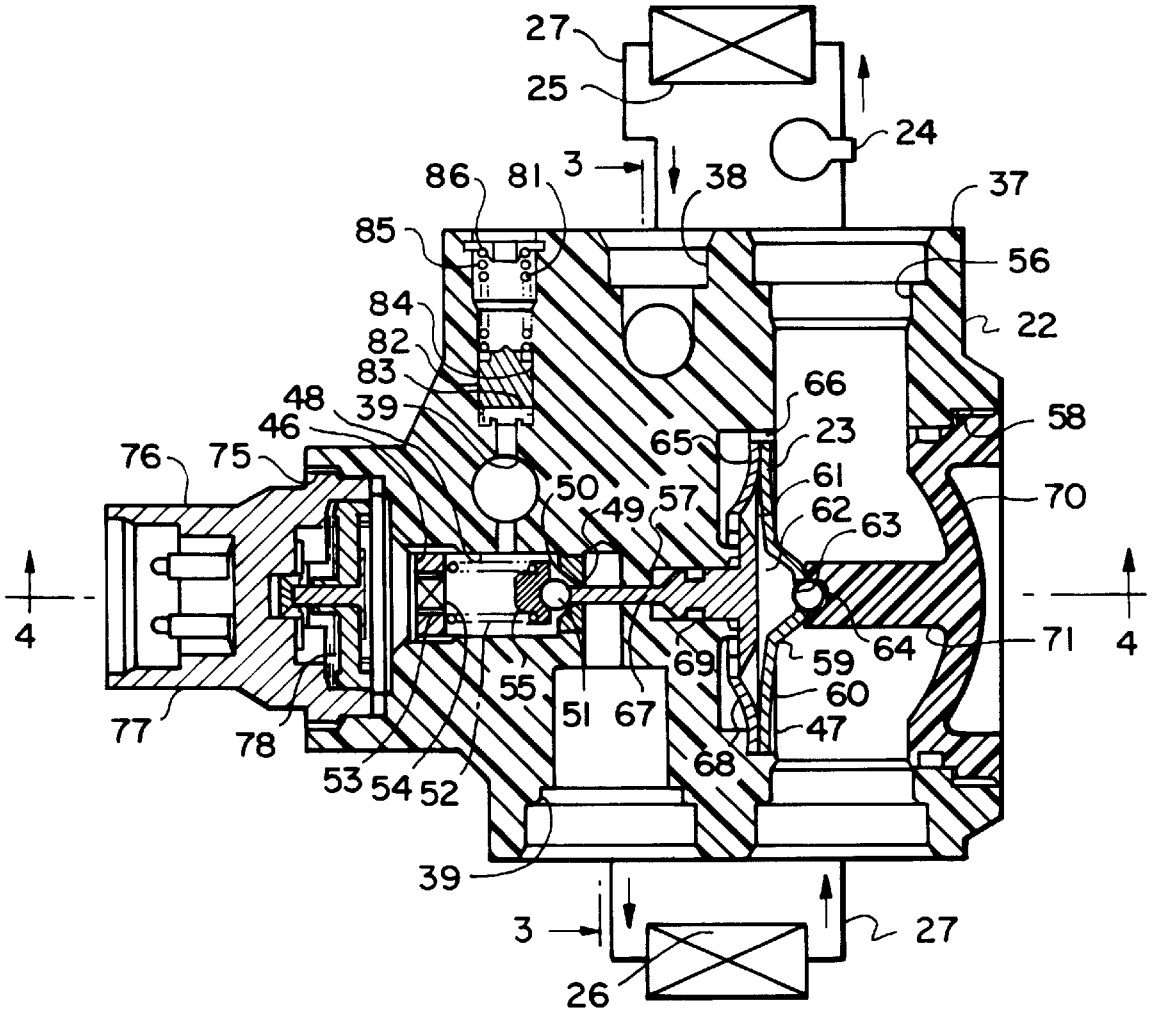
FIG. 2 is a cross-sectional view taken along line 2—2 of FIG. 1.

As shown in FIG. 1, a receiver 22 includes a tank 31 and a head portion 37. A plurality of devices, including a thermal type expansion valve 23 that functions as an expansion mechanism, are incorporated in the head portion 37. As shown in FIG. 2, the receiver 22 is connected to a compressor 24, a condenser 25 and the an evaporator 26 by pipes 27. The compressor 24 discharges refrigerant to the condenser 25. The refrigerant then passes through the receiver 22, the evaporator 26 and then again the receiver 22 before returning to the compressor 24. The compressor 24 is connected to, for example, a vehicle engine by an electromagnetic clutch (not shown) and is driven by the force of the engine.

Figure 3:
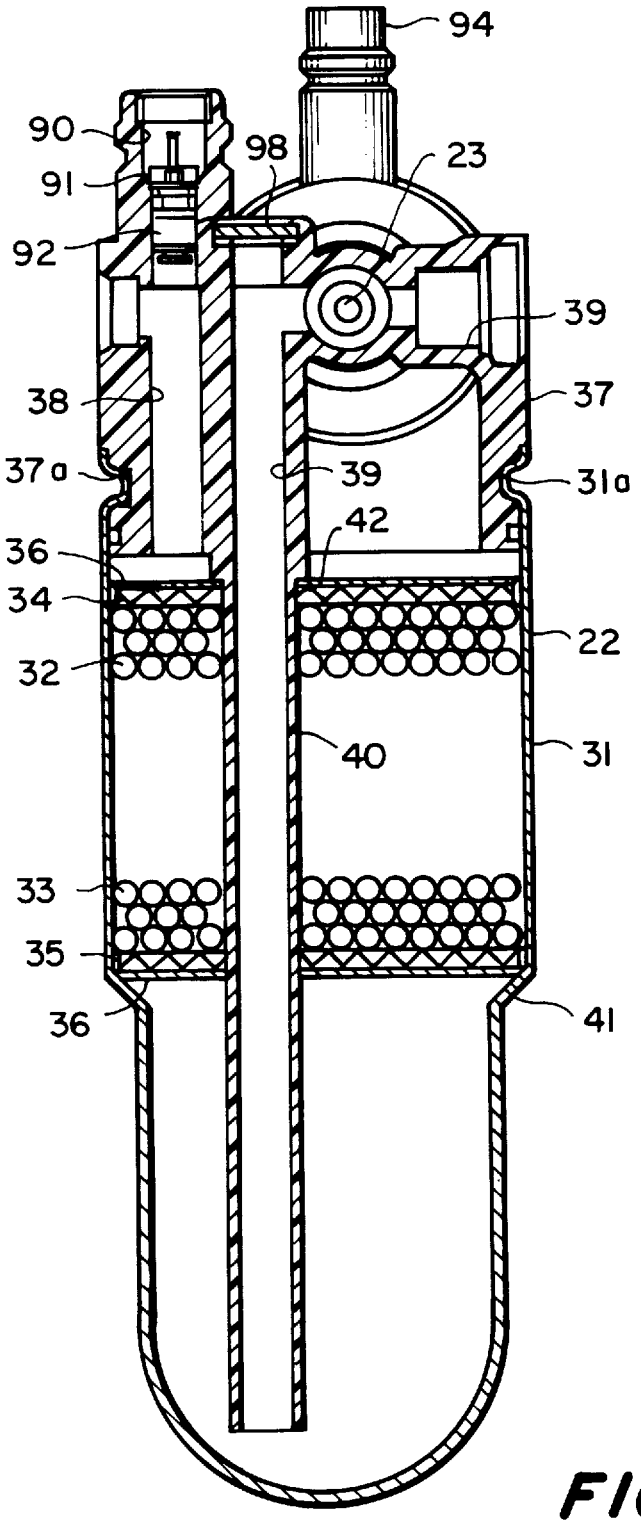
FIG. 3 is a cross-sectional view taken approximately along line 3—3 of FIG. 2.
Figure 4:
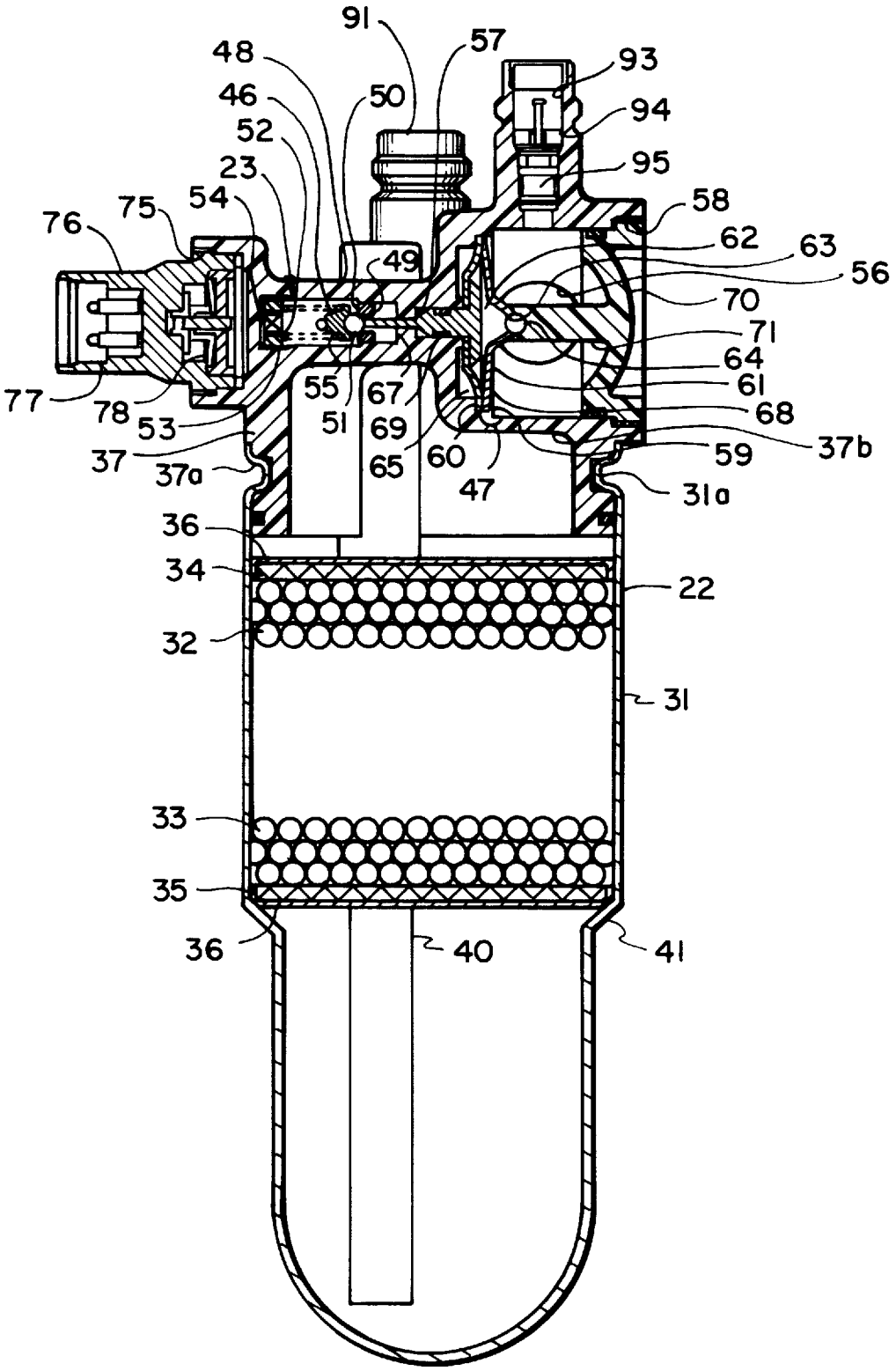
FIG. 4 is a cross-sectional view taken along line 4—4 of FIG. 2.

The tank 31 of the receiver 22, which is illustrated in FIGS. 1, 3 and 4, is made of metal such as aluminum and has a substantially cylindrical shape with all open upper end. A filter 32 is located in the upper portion of the tank 31. The filter 32 includes desiccant 33, a pair of filter members 34, 35 and upper and lower plates 36. The desiccant 33 removes moisture from the refrigerant, while the filter members 34, 35 remove particulate matter from the refrigerant. The plates 36 are meshed or have small holes therein and retain the desiccant 33 and the filter members 34, 35.

The head portion 37 is fitted in the upper opening of the tank 31. An annular projection 31*a* is formed in the upper portion of the tank 31 on its inner wall. The projection 31*a* is engaged with an annular groove 37*a* formed in the head portion 37 thereby sealing the interior of the tank 31.

As shown in FIGS. 2 to 4, an inlet passage 38 and an outlet passage 39 are defined in the heed portion 37. The inlet passage 38 is connected to a pipe 27 that is connected to the outlet of the condenser 25, while the outlet passage 39 is connected to a pipe 27 that is connected to the inlet of the evaporator 26. A refrigerant pipe 40 is connected to the head portion 37 and is extended vertically through the filter 32 to the vicinity of the bottom of the tank 31.

An annular step, or a holder 41, is formed in the middle portion of the tank 31. The pipe 40 has a step, or an engaging portion 42, formed at its proximal end. The filter 32 is held between the holder 41 and the engaging portion 42.

Liquefied refrigerant in the condenser 25 is drawn into the tank 31 through the pipe 27 and the inlet passage 38 and is led to the bottom of the tank 31 through the filter 32 where it is temporarily stored. The stored refrigerant is drawn into the refrigerant pipe 40 through the lower opening thereof. An expansion valve 23 is provided in the outlet passage 39. High temperature, high pressure refrigerant liquid in the pipe 40 is expanded and atomized by the expansion valve 23 when passing through the outlet passage 39. The resultant low temperature, low pressure refrigerant mist is sent to the evaporator 26 through the outlet passage 39 and the pipe 27.

The expansion valve 23 includes a restricting mechanism 46 and a controlling mechanism 47. The restriction mechanism 46 adjusts the flow rate of refrigerant supplied to the evaporator 26 and the control mechanism 47 controls the restriction mechanism 46 in accordance with the temperature of refrigerant supplied to the compressor 24 from the evaporator 26. The mechanisms 46, 47 are incorporated in the head portion 37 of the receiver 22.

The restriction mechanism 46 is located in the outlet passage 39 and includes a valve chamber 48, an orifice 49, which opens in the chamber 48, a valve seat 50 defined at the opening of the orifice 49, a ball-like valve body 51, which faces the valve seat 50 a spring 52 for urging the valve body 50 toward the valve seat 50 and a spring seat located between the spring 52 and the valve body 51. The opening of the orifice 49 is varied by changing the distance between the valve body 51 and the valve sear 50.

An adjusting bolt 53 is screwed to an end of the valve chamber 48. A through hole 54 is formed in the center portion of the bolt 53 for introducing refrigerant to a pressure switch 76, which will be described later. The spring 52 is located between the bolt 53 and the spring seat 55 for urging the valve body 51 toward the valve seat 50. The force of the spring 52 acting on the valve body 51 is adjusted by rotating the adjusting bolt 53.

A passage 56 is defined in and extends through the head portion 37 for allowing flow of refrigerant from the evaporator 26 to the compressor 24. An accommodating hole 57 and a hole 58 are formed on both sides of the passage 56 in the head portion 37. The axes of the holes 57 and 58 are aligned. The control mechanism 47 of the expansion valve 23 is installed in the holes 57, 58.

The controlling mechanism 47 includes a metal first lid 59, a metal second lid 60, and a stainless diaphragm 61 retained between the lids 59, 60. The first and second lids 59, 60 and the diaphragm 61 consist a diaphragm unit. The first lid 59 is exposed to the passage 56. As shown in FIG. 4, the diaphragm unit is installed in a accommodating portion 37*b* formed in the head portion 17. The outer end of the portion 37*b* is almost flush with the outer surface of the tank 31.

A shown in FIGS. 2 to 4, the peripheral portions of the first and second lids 59, 60 are soldered to each other with the diaphragm 61 retained in between. A heat detecting chamber 62 is defined between the first lid 59 and the diaphragm 61. The chamber 62 is filled with saturated gas such as HFC-134*a*. The gas is charged from an opening formed in the center portion of the first lid 59. A ball 64 is then soldered to the opening 63 for permanently sealing the gas the detecting chamber 62.

A pressure chamber 65 is defined between the second lid 60 and the inner wall of the accommodating hole 57. A bore 66 is formed for communicating the pressure chamber 65 with the passage 56. An actuating rod 67 is accommodated in and slides with respect to the accommodating hole 57. A flange 68 is formed at one end of the rod 67. The flange 68 attached to the diaphragm 61. The rod 67 extends from the hole 57 to the outlet passage 39 with its distal end attached to the valve body 51 of the restriction mechanism 46. A seal ring 69 fitted to the peripheral portion of the rod 67 for sealing the pressure chamber 65 from the passage 39.

A lid body 70 is screwed to the hole 58 for closing the hole 58. A pressing rod 71 is formed or, the inner wall of the lid body 70 and intersects the passage 56. The distal end of the rod 71 engages the first lid 59 thereby holding the restricting mechanism 47 in the accommodating hole 57.

The diaphragm unit, which includes the first lid 59, is accommodated in the head portion 37 and is exposed to the passage 56. The diaphragm unit is therefore not exposed to the outside air. Thus, heat is readily transferred between the refrigerant in the passage 56 and the saturated gas in the heat detecting chamber 62 through the lid 59. Therefore, the saturated gas in the detecting chamber 62 expands or contracts in accordance with the temperature of the refrigerant gas passing through the passage 56. The pressure inside the detecting chamber 62 fluctuates with the expansion or contraction of the saturated gas. The diaphragm 61 is displaced rightward or leftward, as viewed in FIG. 2, by the pressure fluctuation in the chamber 62. The movement of the diaphragm 61 is transmitted to the valve body 51 through the actuating rod 67. As a result the opening of the orifice 49 is controlled.

The head portion 37 is a single part made of synthetic resin, which has a low heat conductivity. The lid body 70 is made of the same resin as the receive 22. Therefore, heat conduction between the refrigerant in the passage 56 and the refrigerant in the outlet passage 39 is prevented. The resin head portion 37 further resists heat conduction between the high temperature refrigerant liquid before passing the orifice 49 and the low temperature refrigerant mist that has passed the orifice 49. This suppresses the energy loss from the refrigerant and improves the cooling efficiency of the refrigerant circuit. The resin used for the head portion 37 and the lid portion 70 is preferably polyphenylene sulfide resins. The polyphenylene sulfide has high strength, high heat resistance and high creep resistance. Further, the polyphenylene sulfide is not deteriorated by refrigerant and lubricant contained in the refrigerant.

As shown in FIGS. 2 and 4, a threaded hole 75 is formed in the side portion of the head portion 37 for attaching the pressure switch 76 to the head portion 37. The switch 76 included a casing 77, in which a recess is defined, and a contact member 78 that is housed in the recess. The switch 76 is secured to the head portion 37 by screwing the casing 77 to the hole 75. When the switch 76 is secured to the head portion 37, the recess of the casing 77 is communicated with the valve chamber 48 through the through hole 54 in the adjusting bolt 53.

The pressure switch 76 controls the electromagnetic clutch that connects the compressor 24 with the engine. Specifically, when the pressure of refrigerant that is introduced into the valve chamber 48 front the passage 39 is higher than a predetermined level, the contact member 78 in actuated and causes the clutch to disconnect the compressor 25 from the engine. When the pressure in the refrigerant in the valve chamber 48 is lower than a predetermined level, the contact member 78 is actuated and causes the clutch to connect the compressor 24 with the engine.

As shown in FIG. 2, a hole 81 is defined in the head portion 37. The hole 81 is communicated with a part of the outlet passage 39 that is upstream of the valve chamber 48. A relief valve 82 is directly installed in the hole 81. The relief valve 82 includes a valve seat 83 formed at the inner end of the hole 81, a valve body 84 movably housed in the hole 81, a spring 85 that urges the valve body 84 toward the valve seat 83 and a spring stop 86 that has a bore.

When the pressure of high pressure refrigerant in the passage between the condenser 25 to the restricting mechanism 46 of the expansion valve 23 is higher than a predetermined level, the valve body 84 is moved away from the valve seat 83 against the force of the spring 85. This allows refrigerant to be discharged to the atmosphere from the part of the passage 39 that is upstream of the valve chamber 48. When the pressure of the refrigerant in the passage between the condenser 25 to the mechanism 46 is equal to or lower than a predetermined level, the valve body 84 is moved toward and pressed against the valve seat 84 by the force of the spring 85. Discharge of refrigerant is thus stopped.

Figure 18:
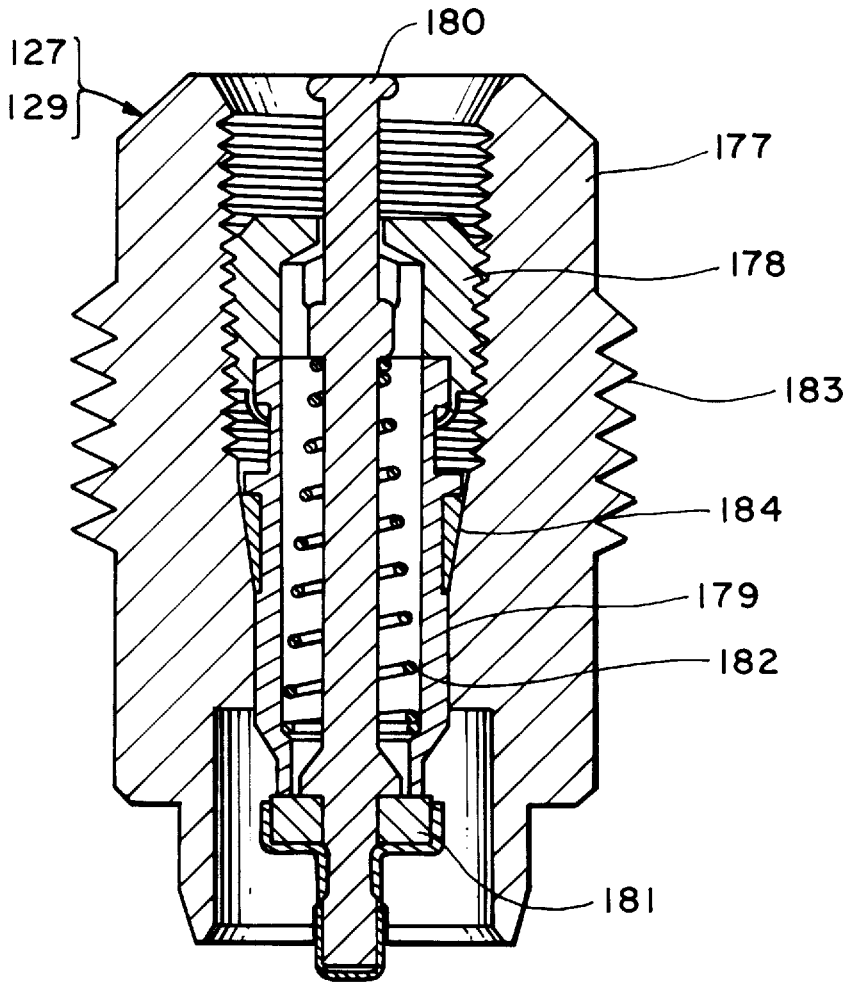
FIG. 18 (Prior Art)
FIG. 18 is a cross-sectional view illustrating a prior art charging valve in the refrigerant circuit of FIG. 16.
Figure 19:
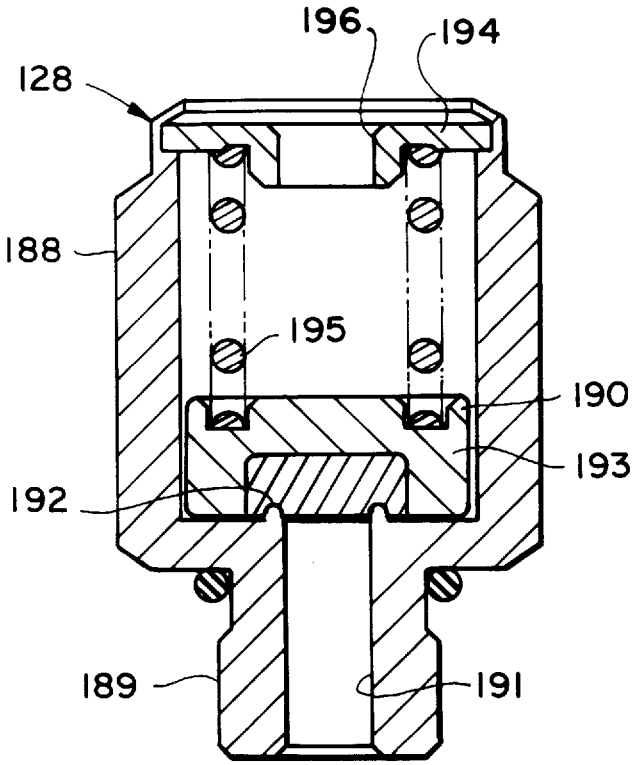
FIG. 19 (Prior Art)
FIG. 19 is a cross-sectional view illustrating a prior art relief valve in the refrigerant circuit of FIG. 16.

As shown in FIGS. 1 and 3, a hole 90 is formed in the head portion 37 and is communicated with the inlet passage 38. A first charging valve 91 is provided in the hole 90 The valve 91 includes a valve core 52 and is secured to the hole 90 by screwing the valve core 92 to the hole 90. The first charging valve 91 is identical with the prior art charging valve illustrated in FIG. 18 except that the valve 91 has no valve stem 177. Refrigerant is charged into a high pressure passage between the condenser 25 to the restricting mechanism 46 through the first charging valve 91.

As shown in FIGS. 1 and 4, a hole 93 is formed in the head portion 37 and is communicated with the passage 56. A second charging valve 94, which has the same construction as the first charging valve 91, is directly secured to the hole 93 by screwing its valve core 95 to the hole 93.

Refrigerant is charged into a low pressure passage from the evaporator 26 to the compressor 24 through the second charging valve 94.

As shown in FIGS. 2 and 3, a sight glass 98 is provided to the top of the head portion 37 at the upstream side of the valve chamber 48. The eight glass 98 allows the bubble condition of refrigerant in the passage 39 to be visually checked. Checking the bubble condition of the refrigerant enables the amount of refrigerant in the refrigerant circuit to be estimated.

The operation of the first embodiment according to the present invention will hereafter be described.

Refrigerant gas is compressed in the compressor 24 to a high pressure and high temperature state. The gas is then condensed in the condenser 25 and liquefied. The liquefied refrigerant enters the tank 31 through the inlet passage 38 formed in the head portion 37 of the receiver 22 and is temporarily stored in the tank 31. The refrigerant liquid in the tank 31 is drawn into the valve chamber 48 of the restricting mechanism 46 through the refrigerant pipe 40. As passing through the orifice 49, the refrigerant is expanded and atomized to a low temperature, low pressure state.

The resultant refrigerant mist is led to the evaporator 26 through the outlet passage 39. The refrigerant is vaporized, or gasified, by the evaporator 26. The gasified refrigerant discharged from the evaporator 26 is returned to the compressor 24 through the passage 56 defined in the head portion 37 of the receiver 22.

The actuating rod 67 of the controlling mechanism 47 of the expansion valve 23 is constantly urged toward the heat detecting chamber 62 by the spring 52, the force of which acts on the rod 67 through the spring seat 55 and the valve body 51. Therefore, the position of the valve body 51 with respect to the valve seat 50 is determined by the equilibrium of the force of the spring 52, the pressure of refrigerant in the pressure chamber 65 and the pressure of the gas sealed in the heat detecting chamber 62. The pressure of refrigerant in the pressure chamber 65 is equal to the pressure of refrigerant passing through the passage 56.

The temperature of the gasified refrigerant passing through the passage 56 is transmitted to the saturated gas sealed in the heat detecting chamber 62 through the first lid 59. The pressure in the detecting chamber 62 is changed in accordance with the temperature of the refrigerant passing through the passage 56. The pressure changes in the chamber 62 is transmitted to the valve body 51 through the diaphragm 61 and the actuating rod 67. This allows the valve body 51 to adjust the opening of the orifice 49. Accordingly, the flow rate of the refrigerant mist supplied to the evaporator 26 is controlled. In this manner, the degree of superheating of the gasified refrigerant at the outlet of the evaporator 26 is continually controlled at a constant value.

The effect of the first embodiment will hereafter be described.

In the above illustrated embodiment, the receiver 22, the expansion valve 23, the first charging valve 91, the relief valve 82, the pressure switch 76, the second charging valve 94 and the sight glass 98 are incorporated in a single unit. This simplifies the structure of the refrigerant circuit. Therefore, unlike in the prior art circuit, the devices need not to be assembled independently. Thus the manufacture cost of the circuit is lowered. The head portion 37 of the receiver 22 includes various devices such as the expansion valve 23. Therefore, the receiver 22 replaces various independent devices described in the prior art section. This eliminates the necessity for the space for accommodating the prior art devices of the prior art. Further, installation of the devices in the pipes 27 is facilitated.

The restricting mechanism 46 and the control mechanism 47 of the expansion valve 23 are directly installed in the head portion 37. This reduces the number of parts in comparison with housing the devices 46, 47 before installing them in the head portion 37.

The head portion 37 has the accommodating portion **37*b* is protruding inward in the space above the tank 31. The diaphragm unit is accommodated in the portion 37*b*. Therefore, the diaphragm unit and a part of the head portion 37 covering the unit are prevented from protruding laterally from the tank 31. This reduces the size of the receiver 22**.

Refrigerant in the tank 31 is drawn into the refrigerant pipe 40 and the outlet passage 39. The refrigerant then passes through the restricting mechanism 46 in the head portion 37. The refrigerant is drawn into the evaporator 26 and then passes the passages 56 of the head portion 37. The controlling mechanism 47 in the head portion 37 controls the restricting mechanism 46 in accordance with the temperature of refrigerant passing through the passage 56. The expansion valve 23 is incorporated in the head portion 37 of the receiver 22 above the tank 31. This construction simplifies the construction of a refrigerant passage between the tank 31 and the expansion valve 23 compared to an apparatus having separate receiver 22 and expansion valve 23.

The heat detecting chamber 62 in the controlling mechanism 47 of the expansion valve 23 is exposed to the passage 56 defined in the head portion 37 of the receiver 22. This construction allows the temperature of the refrigerant passing through the passage 56 to be accurately transmitted to the saturated gas sealed ice the heat detecting chamber 62 without being affected by the temperature of the outside air. Accordingly, the flow rate of refrigerant list supplied to the evaporator 26 is accurately controlled in accordance with the temperature of refrigerant in the passage 56.

The charging valves 91, 94 for charging refrigerant into the refrigerant circuit are provided to the head portion 37. The closely located charging valves 91, 94 allow charging of the refrigerant into the circuit to be efficient. When the air conditioner is not operating, the refrigerant passage in the circuit is divided into two parts by the compressor 24 and the expansion valve 23. Therefore, refrigerant must be charged into the circuit at two different locations.

The head portion 37 of the receiver 22 is made of synthetic resin. Compared to metal, resin has lower heat conductivity. Therefore, heat conduction between the refrigerant in the passage 56 and the refrigerant in the passage 39 is resisted. Further, this construction resists the heat conduction between the high temperature refrigerant liquid before passing through the orifice 49 and the low temperature refrigerant mint after passing through the orifice 49. Also, little ambient heat about the head portion 37 is transmitted to inside the head portion 37. A significant increase in the temperature of the refrigerant is accordingly prevented, and the cooling efficiency of the refrigerant circuit is thus improved. The flow rate of the refrigerant is therefore accurately controlled.

Since shaping of resin is easier than shaping of metal, the head portion 37, which has a complicated structure for accommodating the various devices, is easily and accurately machined.

The head portion 37 is made of polyphenylene sulfide. The head portion 37 therefore has high strength, high heat resistance and high creep resistance. Further, the head portion 37 is not deteriorated by refrigerant and lubricant contained in the refrigerant.

Figure 5:
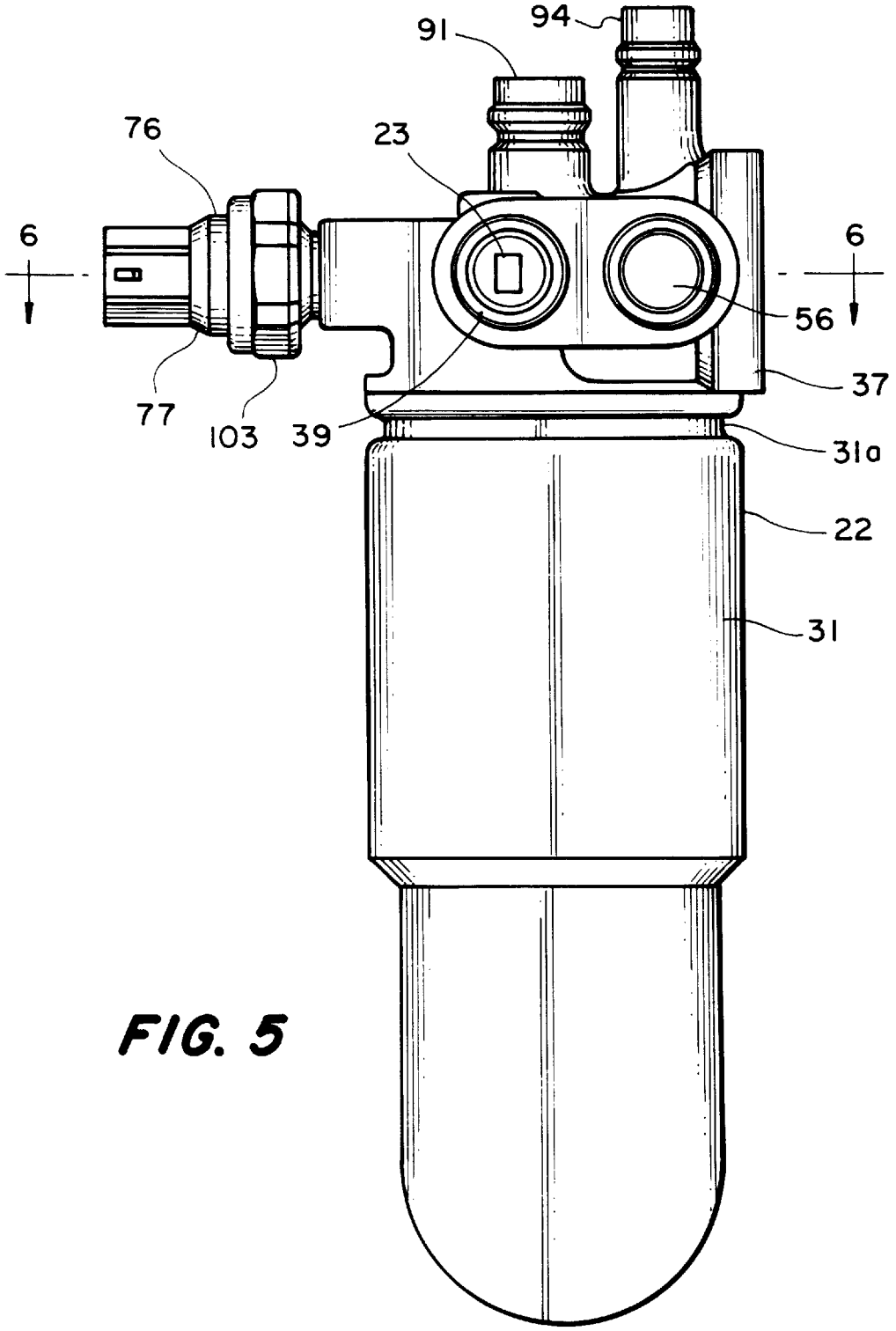
FIG. 5 is a front view illustrating a receiver having an expansion mechanism according to a second embodiment of the present invention.
Figure 6:
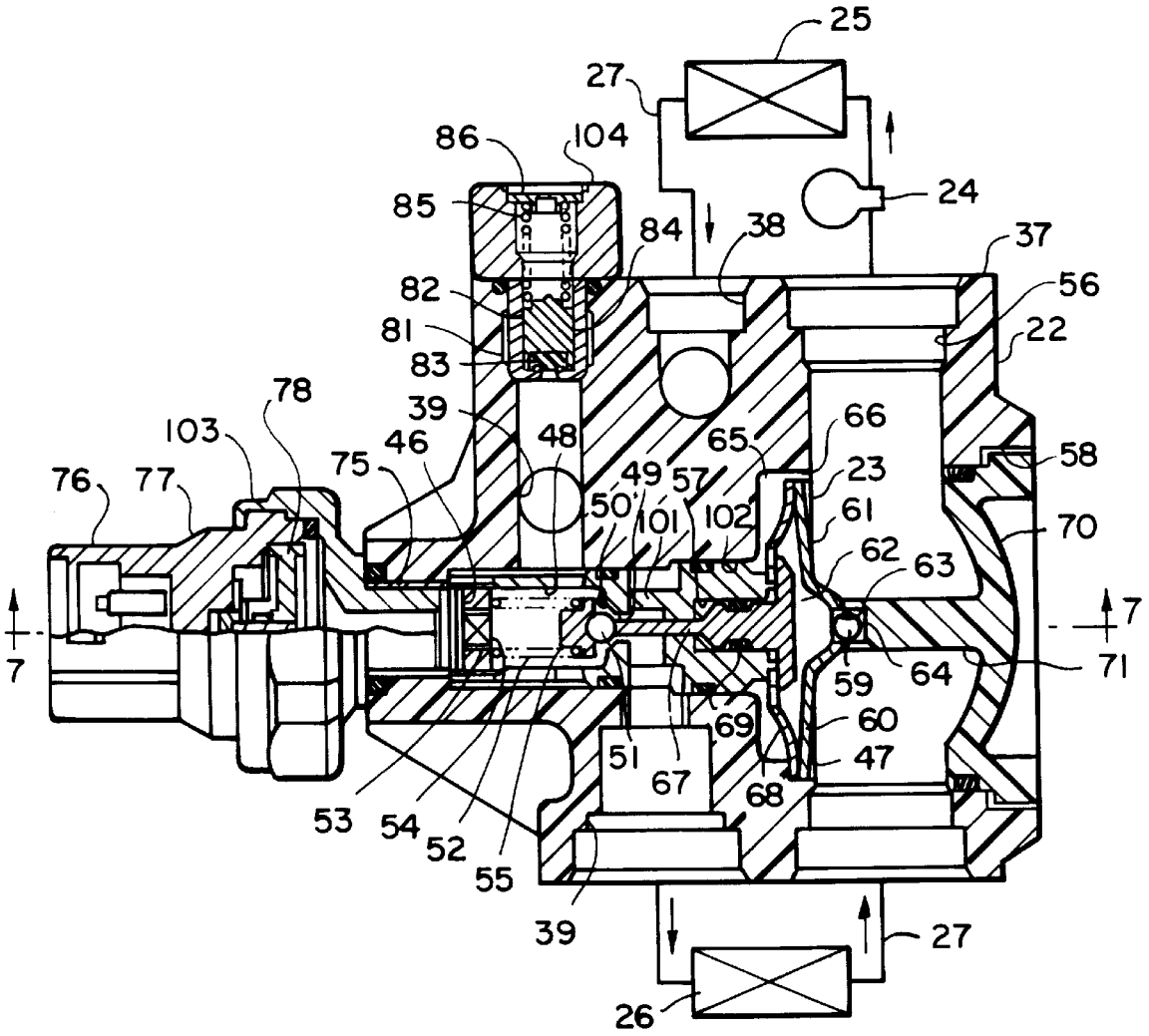
FIG. 6 is a cross-sectional view taken along line 6—6 of FIG. 5.
Figure 7:
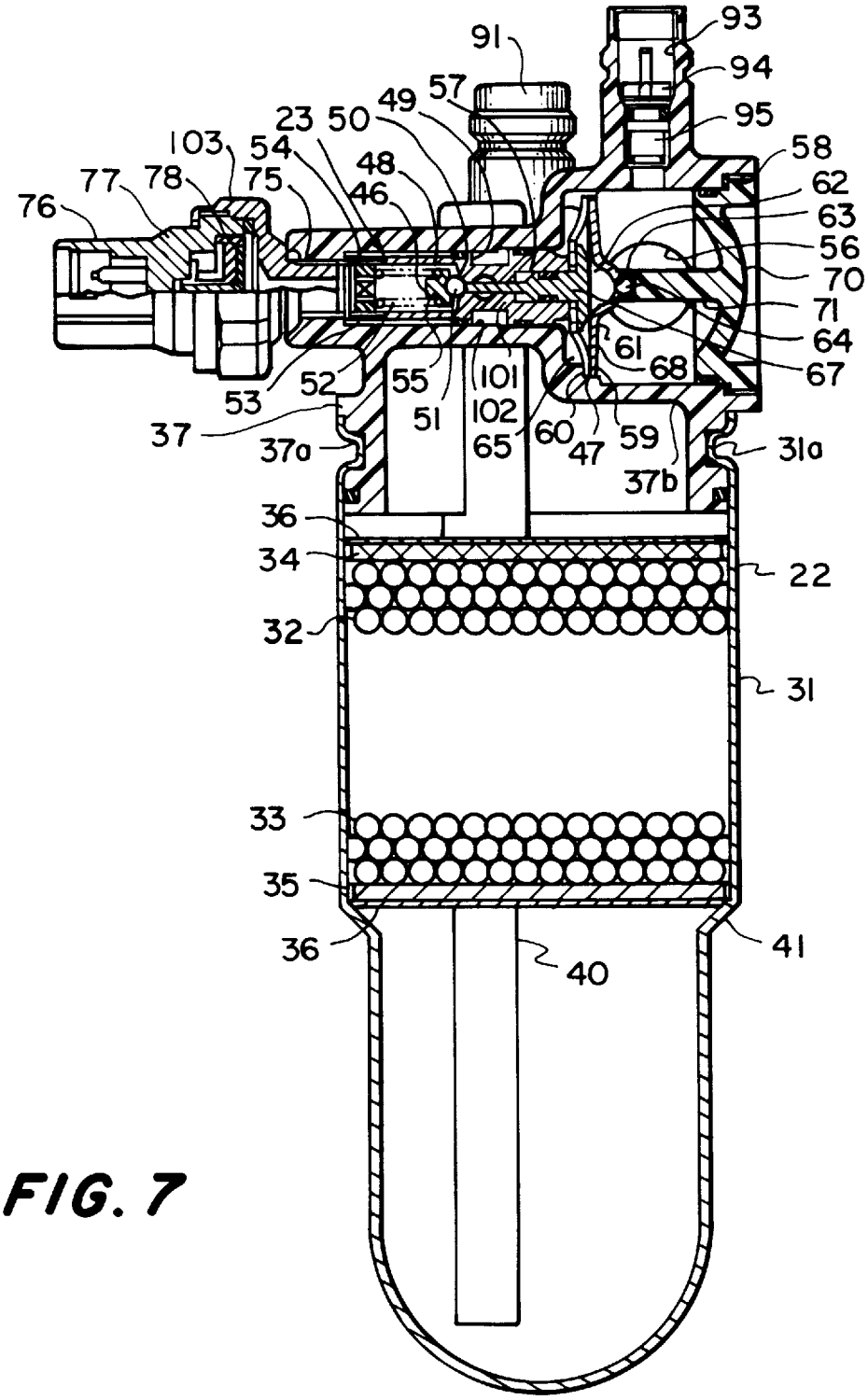
FIG. 7 is a cross-sectional view taken along line 7—7 of FIG. 6.
Figure 8:
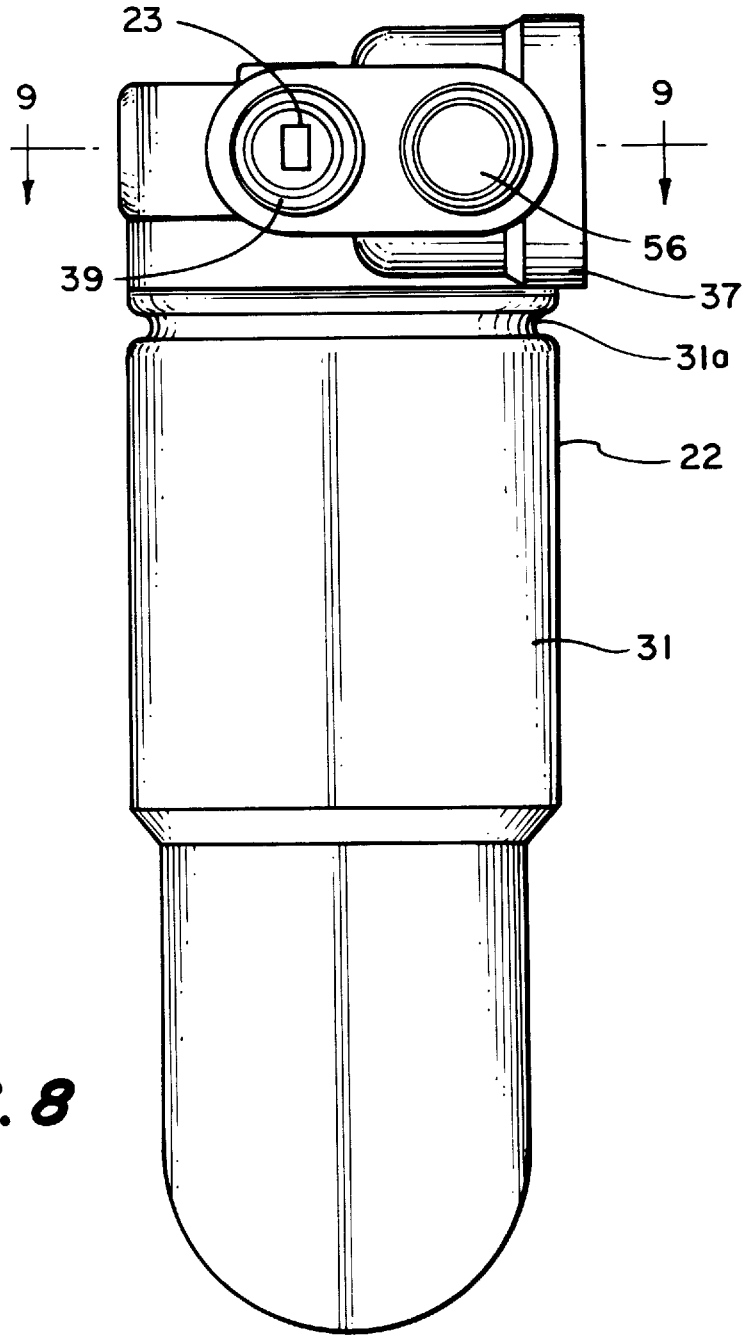
FIG. 8 is a front view illustrating a receiver having an expansion mechanism according to a third embodiment of the present invention.
Figure 9:
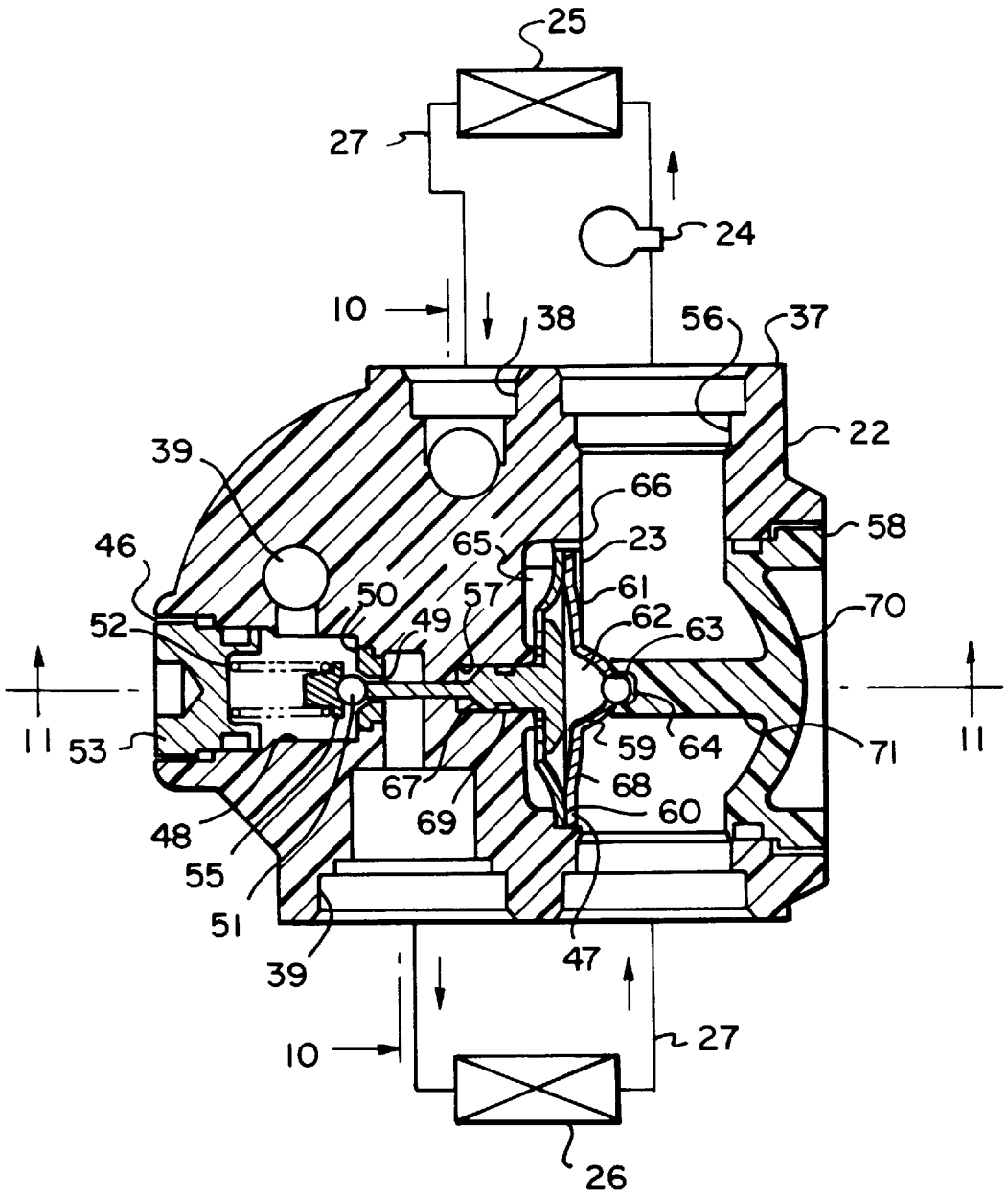
FIG. 9 is a cross-sectional view taken along line 9—9 of FIG. 8.
Figure 10:
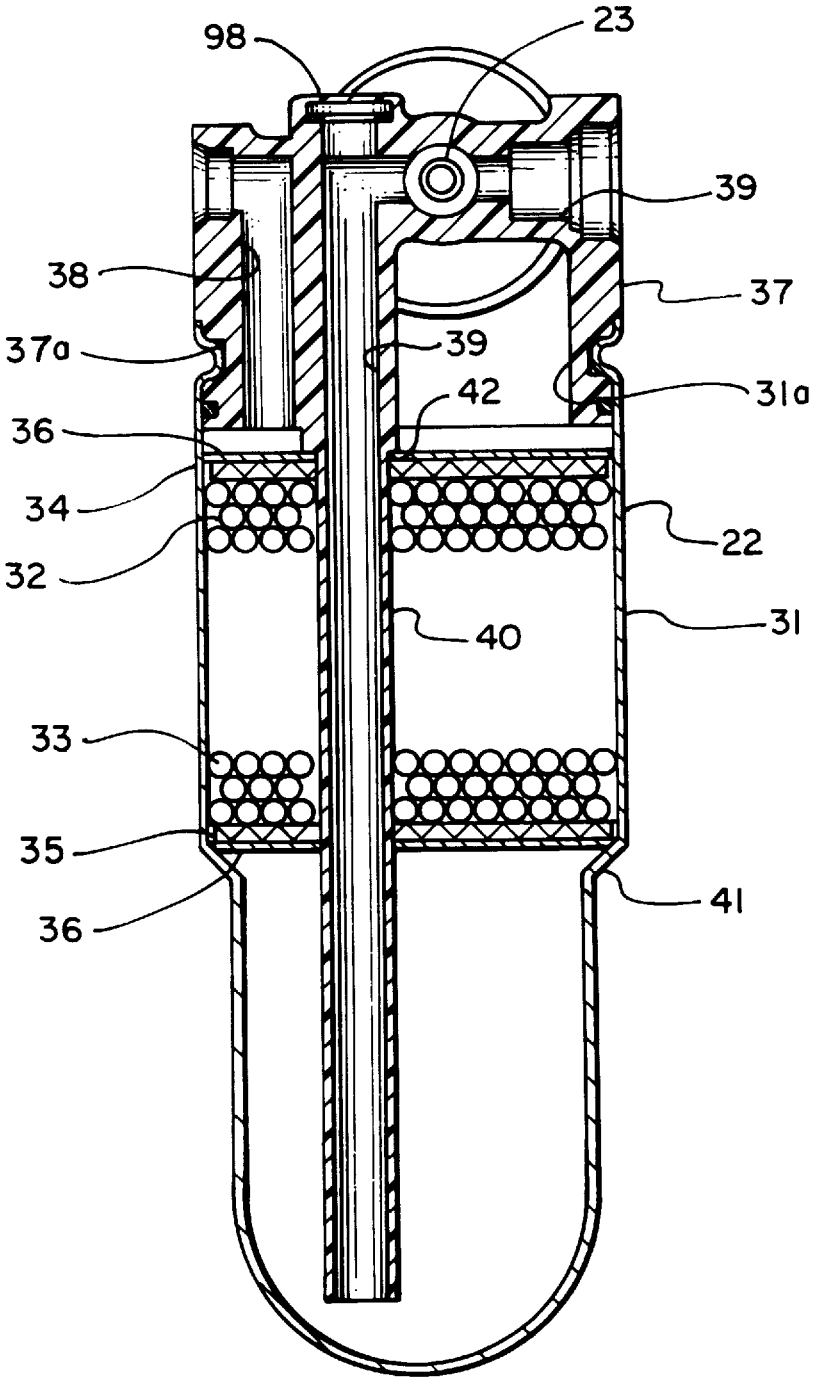
FIG. 10 is a cross-sectional view taken approximately along line 10—10 of FIG. 9.
Figure 11:
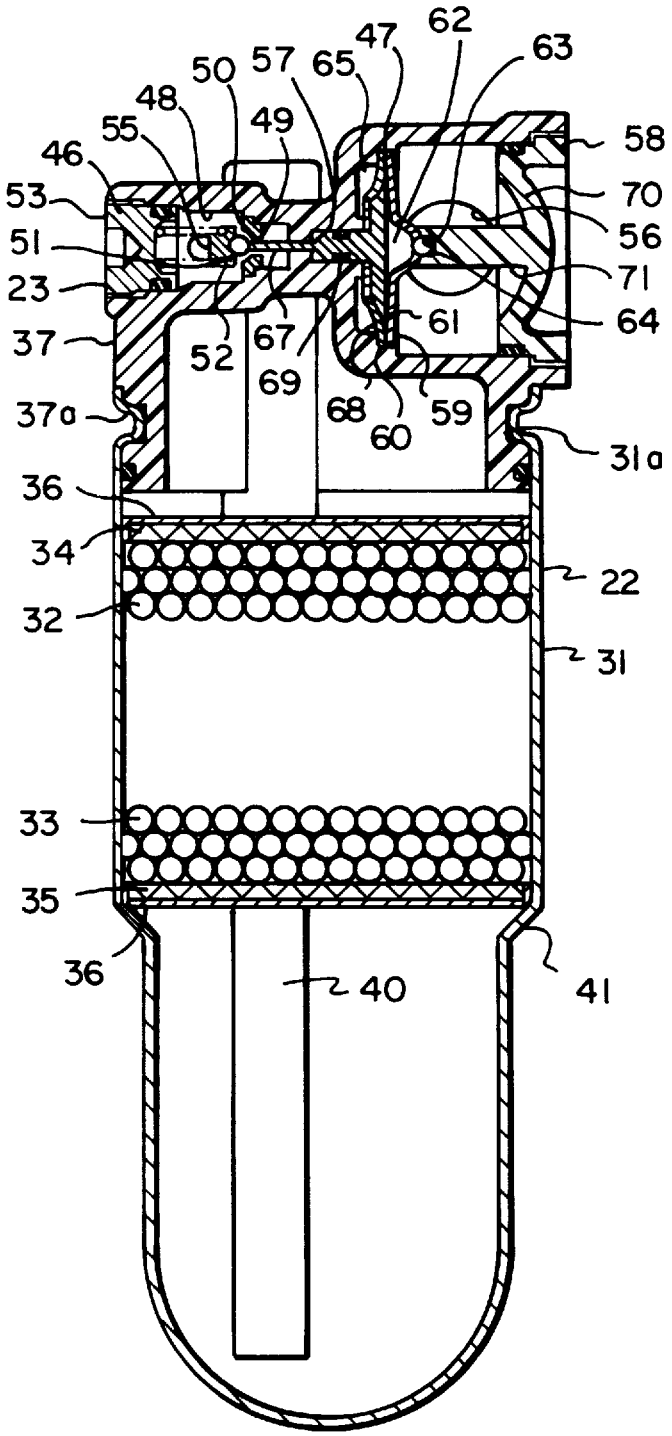
FIG. 11 is a cross-sectional view taken along line 11—11 of FIG. 9.
Figure 12:
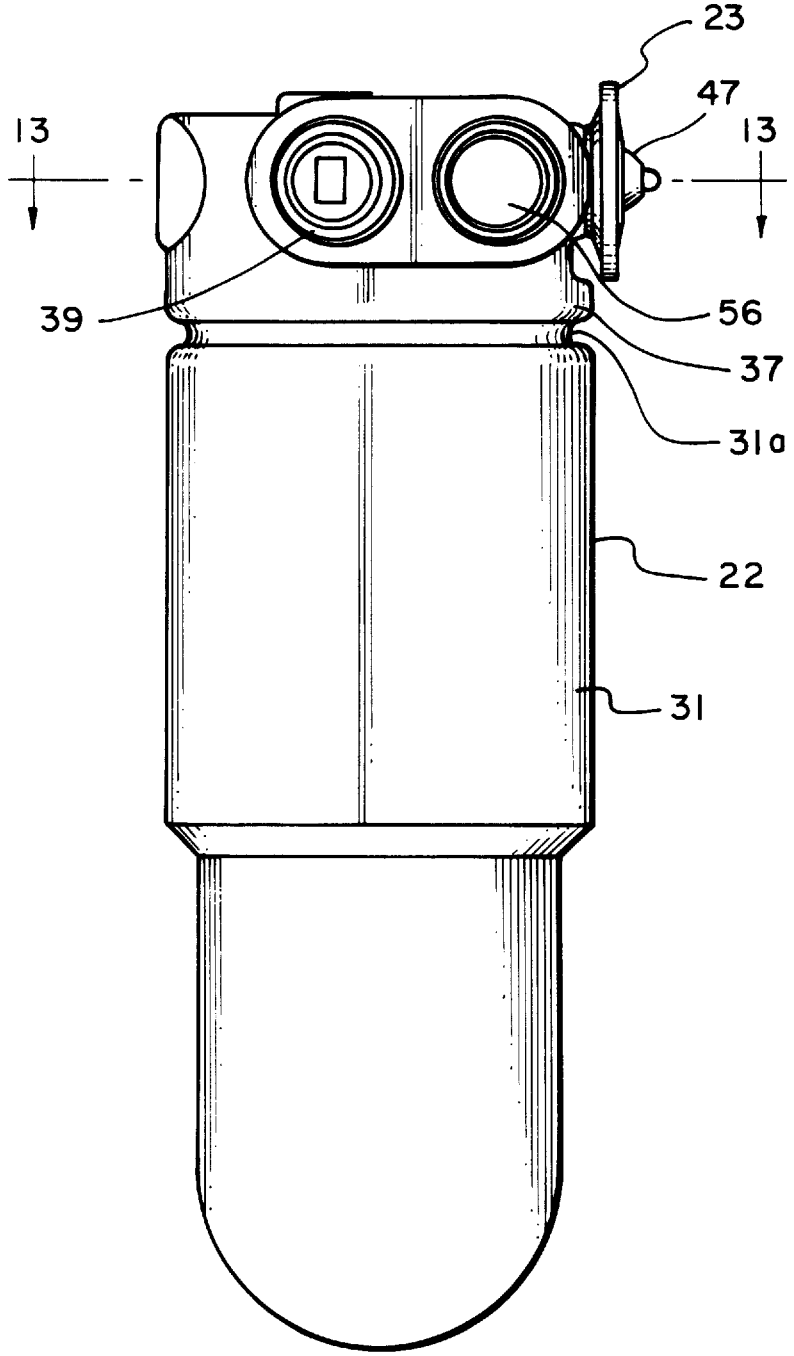
FIG. 12 is a front view illustrating a receiver having an expansion mechanism according to a fourth embodiment of the present invention.
Figure 13:
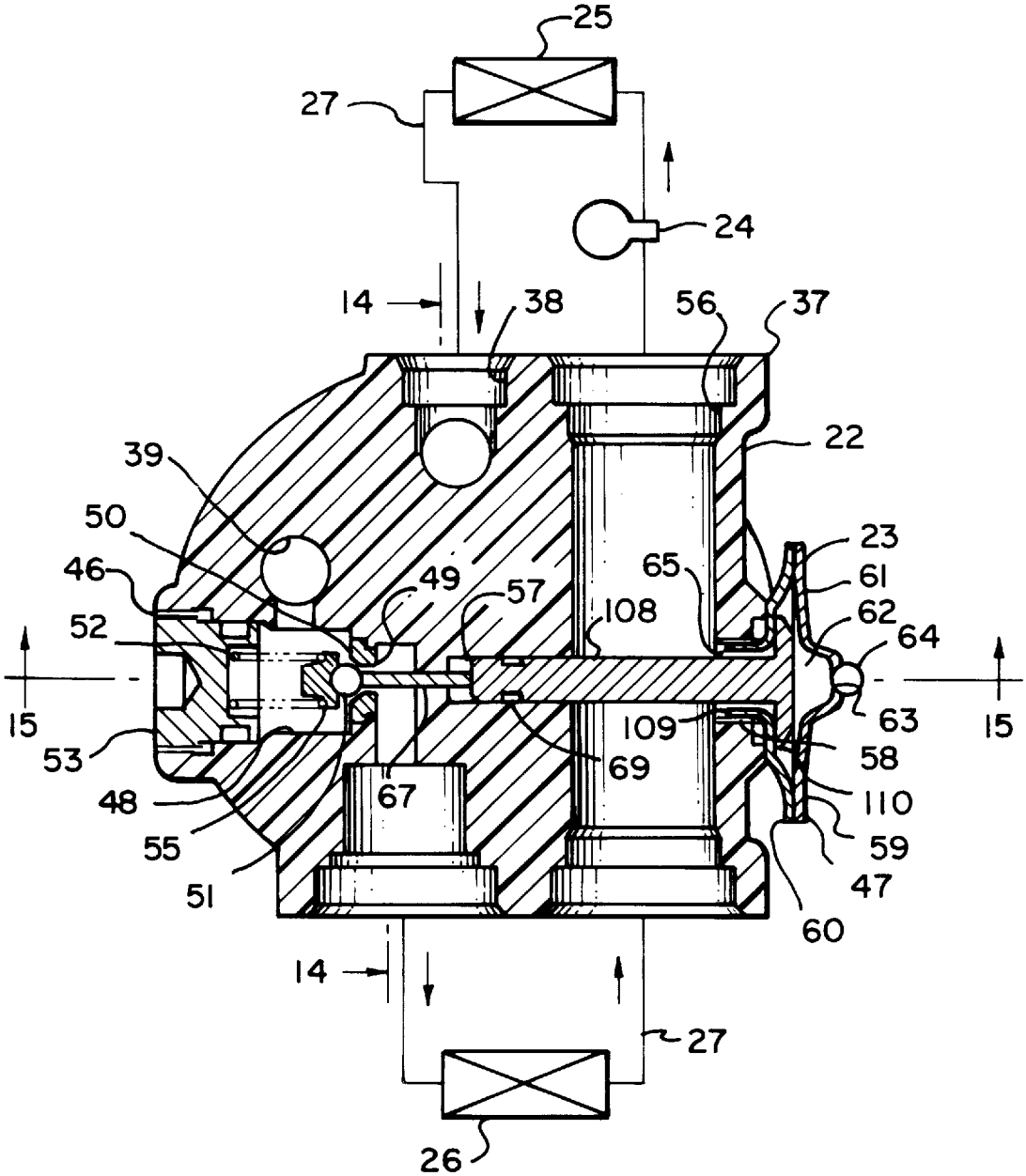
FIG. 13 is a cross-sectional view taken along line 13—13 of FIG. 12.
Figure 14:
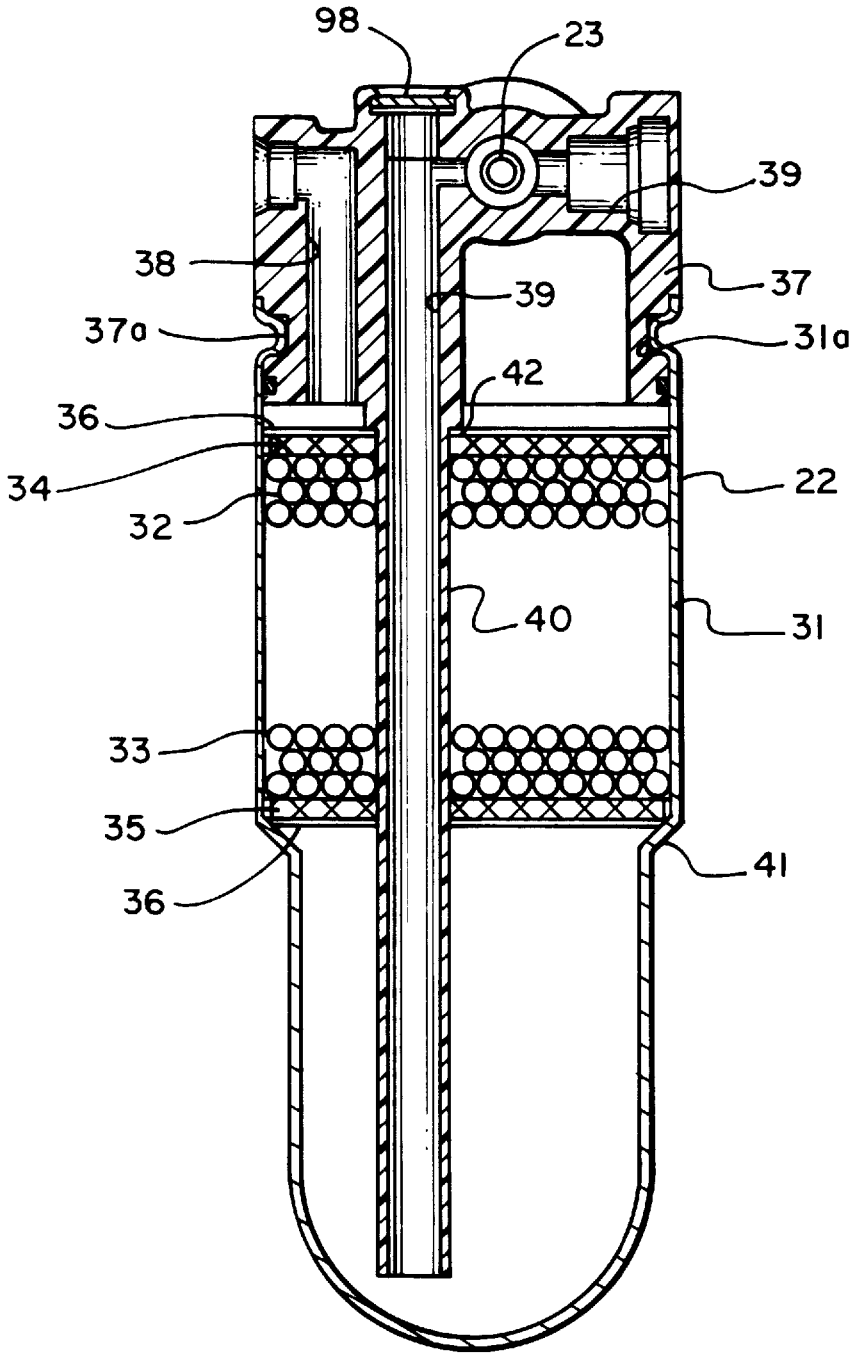
FIG. 14 is a cross-sectional view taken approximately along line 14—14 of FIG. 13.
Figure 15:
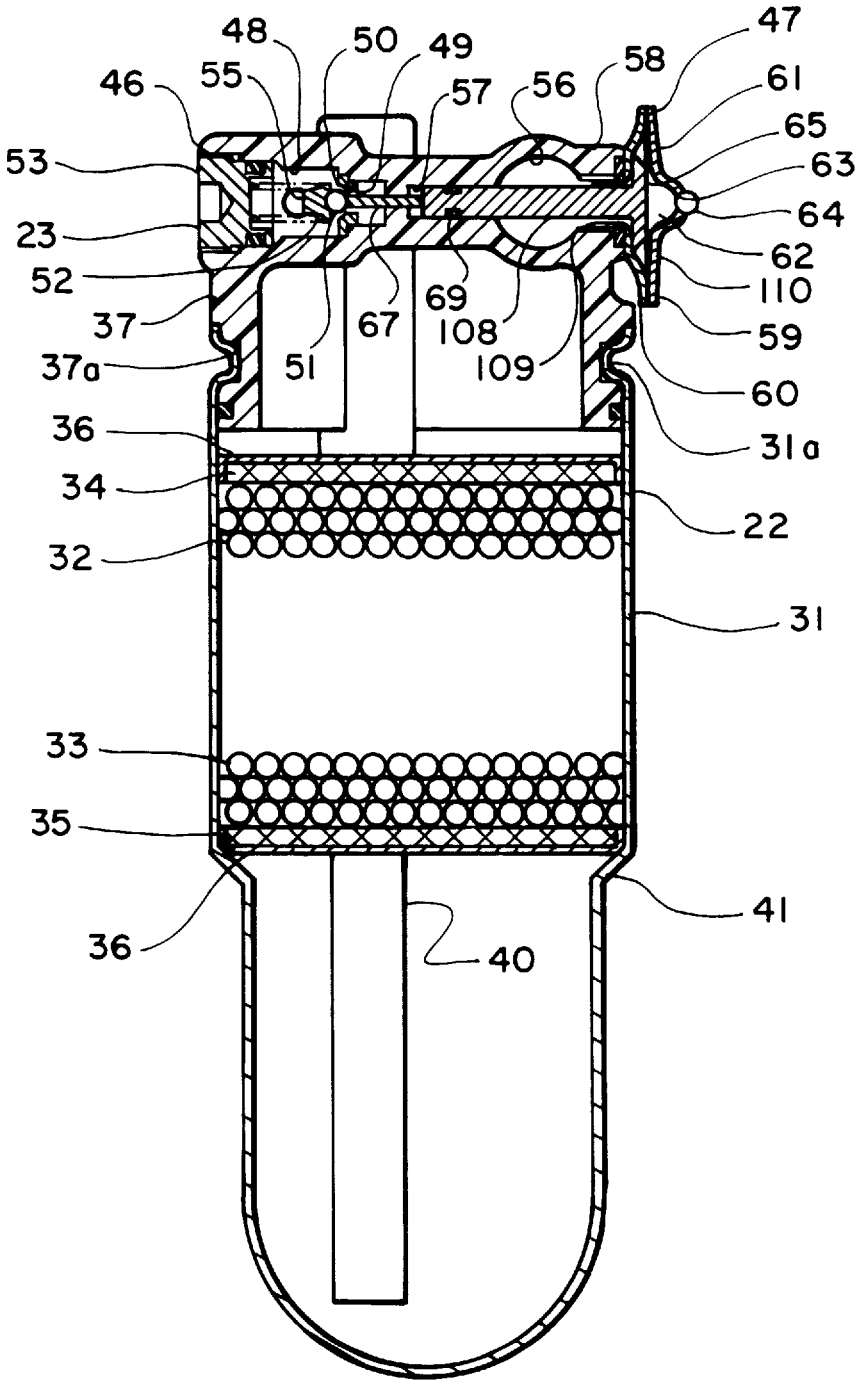
FIG. 15 is a cross-sectional view taken along line 15—15 of FIG. 13.
Figure 16:
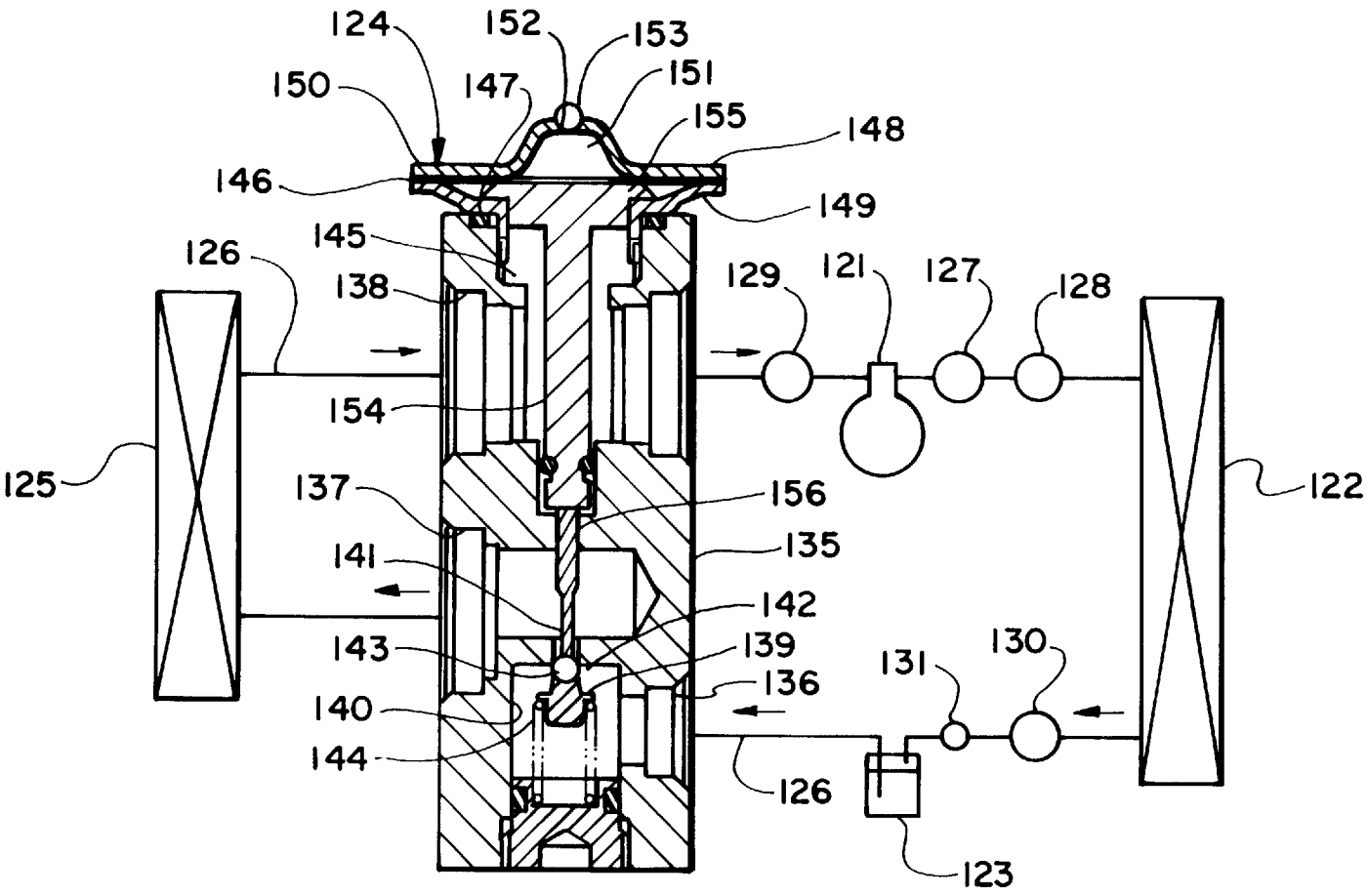
FIG. 16 (Prior Art)
FIG. 16 is a block diagram illustrating a prior art refrigerant circuit.
Figure 17:
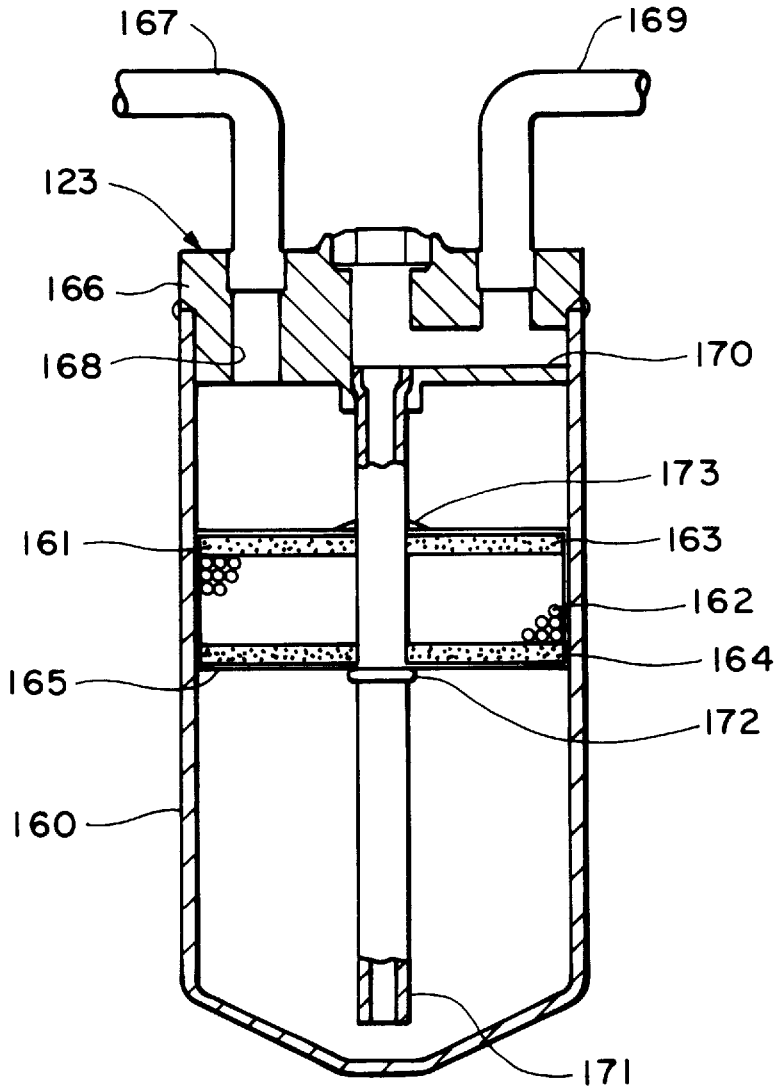
FIG. 17 (Prior Art)
FIG. 17 is a cross-sectional view illustrating a prior art receiver in the refrigerant circuit of FIG. 16.

A second embodiment of the present invention will now be described with reference to FIGS. 5 to 7. The differences from the first embodiment will mainly be discussed below, and like or the same reference numerals are given to those components that are like or the same as the corresponding components of the first embodiment.

In the second embodiment, the restricting mechanism 46 and the controlling mechanism 47 of the expansion valve 23 are accommodated in a housing 101. A hole 102 is defined in the head portion of the receiver 22 to extend from the passage 56 to the passage 39. The housing 101 is installed in the hole 102.

The valve chamber 48 in defined in the housing 101. Similar to the first embodiment, the restricting mechanism 46 having a valve body 51 is housed in the valve chamber 48. A chamber 57 is defined in the housing 103 for accommodating the control mechanism 47, which includes the actuating rod 67.

The pressure switch 76 includes a casing 77, which has a recess, the contact member 78, which is accommodated in the recess, and a cover 103 screwed to the casing 77 to cover the contact member 78. The pressure switch 76 is secured to the head portion 37 by screwing the cover 103 to the threaded hole 75 of the head portion 37.

The relief valve 82 consists of the valve body 84 and other parts accommodated in the housing 104. The relief valve 82 is secured to the head portion 37 by screwing the housing 104 to the hole 81 defined in the head portion 37.

In the second embodiment, the restricting mechanism 46 and the controlling mechanism 47 of the expansion valve 23 are accommodated in the housing 101. Then, the housing 101 is installed in the hole 102 defined in the head portion 37. Thus, the parts that consist the mechanisms 46 and 47 need not to be separately installed into the head portion 37. This facilitates the installing of the mechanisms 46 and 47.

The pressure switch 76 is secured to the head portion 37 with the contact member 78 hold between the casing 77 and the cover 103. Similarly, the relief valve 82 is installed in the head portion 37 with the valve body 84 and the other parts accommodated in the housing 104. In other words, the previously assembled pressure switch 76 and the relief valve 82 are installed in the head portion 37. Therefore, commercially available devices may be used as the pressure switch 76 and the relief valve 82. Moreover, the switch 76 and the valve 82 are readily installed in the head portion 37.

A third embodiment of the present invention will hereafter be described with reference to FIG. 8 to 11. The differences from the first embodiment will mainly be discussed below, and like or the same reference numerals are given to those components that are like or the same as the corresponding components of the first embodiment.

In the third embodiment, the receiver 22 and the expansion valve 23 are integrated to for a single unit. Specifically, the restricting mechanism 46 and the controlling mechanism 47 of the expansion valve 23 are directly installed in the head portion 37 of the receiver 22. Further, the sight glass 98 is provided in the head portion 37.

The restricting and controlling mechanisms 46, 47 have substantially the same construction as the mechanisms 46, 47 described in the first embodiment. The heat detecting chamber 62 of the controlling mechanism 47 is exposed to the passage 56. In the third embodiment, the head portion 37 is not provided with a pressure switch. Therefore, the adjusting bolt 53 of the mechanism 46 has no through hole and the valve chamber 48 is sealed by the bolt 53.

Employing the integrated unit including the receiver 22 and the expansion valve 23 simplifies the structure of the circuit and lowers the cost. Further, the unit reduces the necessary space for the circuit and simplifies the assembling of the circuit.

A fourth embodiment of the present invention will hereafter be described with reference to FIG. 12 to 15. The differences from the third embodiment will mainly be discussed below, and like or the same reference numerals are given to those components that are like or the same as the corresponding components of the third embodiment.

Similar to the third embodiment, the receiver 22 and the expansion valve 23 are integrated to form a single unit in the fourth embodiment. Specifically, the restricting mechanism 46 and the controlling mechanism 47 of the expansion valve 23 are directly installed in the head portion 37 of the receiver 22. The head portion 37 is provided with the sight glass 98.

The control mechanism 47 of the expansion valve 23 includes the first lid 59, the second lid 60, the diaphragm 61, the heat detecting chamber 62 and the actuating rod 67. The mechanism 47 of the fourth embodiment further includes a heat detecting rod 108 made of metal having high heat conductivity such as aluminum. A threaded cylinder 109 is integrally formed with the second lid 60. Screwing the cylinder 109 to the hole 58 in the head portion 37 secures the controlling mechanism 47 to the head portion 37. In this state, the heat detecting chamber 62 is exposed to the outside.

The heat detecting rod 108 is movably accommodated in the hole 57 and intersects the passage 56. A flange 110 is formed at one end of the rod 108 and is attached to the diaphragm 61. The actuating rod 67 is located between the heat detecting rod 108 and the valve body 51 for transmitting the sliding motion of the heat detecting rod 108 to the valve body 51.

In this embodiment, the heat of the gasified refrigerant passing through the passage 56 is transmitted to the saturated gas sealed in the heat detecting chamber 62 through the heat detecting rod 108. The pressure in the chamber 62 changes in accordance with the temperature of the refrigerant passing through the passage 56. The pressure changes in the chamber 62 is transmitted to the valve body 51 through the diaphragm 61 and the rods 108, 67. This causes the valve body 51 to adjust the opening of the orifice 49. Accordingly, the flow rate of the refrigerant mist supplied to the evaporator 26 is controlled. In this manner, the receiver 22 having an expansion mechanism continually controls the degree of superheating of the gasified refrigerant at the outlet of the evaporator 26 at a constant value.

The fourth embodiment has the same advantages as the third embodiment. Particularly, in the fourth embodiment, the heat detecting chamber 62 is exposed to the outside of the head portion 37 and the heat detecting rod 108 extends intersecting the passage 56. This simplifies the construction of the head portion 37 thereby reducing the size of the head portion 37. This structure also simplifies installing of the mechanism 47 to the head portion 37. Further, the hole 58, which is connected to the passage 56, is closed by the second lid 60 of the control mechanism 47. This structure eliminates the necessity for another lid for closing the hole 58.

The present invention may be embodied in the following forms.

In the receiver 22 of the first embodiment, the heat detecting chamber 62 of controlling mechanism 47 in the expansion valve 23 may be exposed to the outside of the head portion 37, and the heat detecting rod 108 may be provided to intersect, the passage 56 as in the fourth embodiment.

In the receiver 22 of the third embodiment, the housing 101, in which the restricting mechanism 46 and the controlling mechanism 47 of the expansion valve 23 are accommodated, may be installed in the hole 102 defined in the head portion 37.

Therefore, the present examples and embodiments are to be considered as illustrative and not restrictive and the invention is not to be limited to the details given herein, but may be modified within the scope and equivalence of the appended claims.

What is claimed is:

1. A receiver located in a refrigerating circuit that includes a compressor, a condenser, an expansion mechanism and an evaporator, wherein said receiver receives and temporarily reserves liquefied refrigerant sent from the compressor by way of the condenser, wherein said expansion mechanism atomizes the liquefied refrigerant sent from the receiver and supplies the atomized refrigerant to the evaporator, said receiver comprising:

a tank for reserving the liquefied refrigerant sent from the condenser; and a head portion located on said tank, wherein said head portion is made of a synthetic resin, and wherein said head portion houses said expansion mechanism.

2. The receiver according to claim 1, wherein said expansion mechanism includes:

an adjusting mechanism for adjusting the flow rate of the refrigerant supplied to the evaporator from the tank; and a control mechanism for controlling said adjusting mechanism in accordance with the temperature of the refrigerant transferred to said compressor from said evaporator.

3. The receiver according to claim 2, wherein said adjusting mechanism and said control mechanism are directly installed in said head portion.

4. The receiver according to claim 2, wherein said expansion mechanism has a housing for accommodating said adjusting mechanism and said control mechanism, wherein said head portion has a hole for receiving said housing, wherein said adjusting mechanism and said control mechanism are installed in the head portion when said housing is installed in the hole.

5. The receiver according to claim 2, wherein said head portion has a first passage for introducing the refrigerant from the condenser to the tank, a second passage for supplying the refrigerant from the tank to the evaporator and a third passage for transferring the refrigerant to the compressor from the evaporator, wherein said adjusting mechanism is located in said second passage, and wherein said control mechanism is located in said third passages to detect the temperature of the refrigerant flowing in the third passage.

6. The receiver according to claim 5, wherein said adjusting mechanism has a restriction located in the second passage and a valve member for adjusting the size of the restriction, wherein said control mechanism has a sealed heat detecting chamber filled with gas, a diaphragm movable in accordance with the pressure in the detecting chamber and a transmitting member for transmitting the movement of the diaphragm to the valve member, and wherein heat of the refrigerant flowing in the third passage is transmitted to the gas in the detecting chamber.

7. The receiver according to claim 6, wherein said detecting chamber is located in said head portion such that it is adjacent to said third passage.

8. The receiver according to claim 6, wherein said detecting chamber projects from the head portion, and wherein said transmitting member extends across the third passage to transmit the heat of the refrigerant in the third passage to the gas in the detecting chamber.

9. The receiver according to claim 1, wherein said synthetic resin includes polyphenylene sulfide.

10. A receiver located in a refrigerating circuit that includes a compressor, a condenser, an expansion valve and an evaporator, wherein said receiver receives and temporarily reserves liquefied refrigerant sent from the compressor by way of the condenser, wherein said expansion valve atomizes the liquefied refrigerant sent from the receiver and supplies the atomized refrigerant to the evaporator, said receiver comprising:

a tank for reserving the liquefied refrigerant sent from the condenser;

a head portion located on said tank, wherein said head portion has a first passage for introducing the refrigerant from the condenser to the tank, a second passage for supplying the refrigerant from the tank to the evaporator and a third passage for transferring the refrigerant to the compressor from the evaporator, and wherein said head portion houses said expansion valve;

an adjusting mechanism and a control mechanism included in said expansion valve, wherein said adjusting mechanism is located in said second passage to adjust the flow rate of the refrigerant supplied to the evaporator from the tank, and wherein said control mechanism is located in said third passage to control said adjusting mechanism in accordance with the temperature of the refrigerant flowing in the third passage;

a first charging valve located in the head portion in the first passage to charge the refrigerant into the first passage; and a second charging valve located in the head portion in the third passage to charge the refrigerant into the third passage.

11. The receiver according to claim 10 further comprising a relief valve located in the head portion in the second passage upstream of the adjusting mechanism, wherein said relief valve opens to release the refrigerant from the second passage when the pressure in the second passage upstream of the adjusting mechanism is higher than a predetermined level.

12. The receiver according to claim 11 further comprising a sight glass located in the head portion in the second passage upstream of the adjusting mechanism, wherein said sight glass allows the refrigerant flowing in the second passage to be visually checked.

13. The receiver according to claim 12 further comprising a pressure switch located in the head portion in the second passage upstream of the adjusting mechanism, wherein said pressure switch acts in accordance with the pressure in the second passage upstream of the adjusting mechanism.

14. A receiver located in a refrigerating circuit that includes a compressor, a condenser, an expansion valve and an evaporator, wherein said receiver receives and temporarily reserves liquefied refrigerant sent from the compressor by way of the condenser, wherein said expansion valve atomizes the liquefied refrigerant sent from the receiver and supplies the atomized refrigerant to the evaporator, said receiver comprising:

a tank for reserving the liquefied refrigerant sent from the condenser;

a head portion located on said tank, said head portion being made of a synthetic resin, wherein said head portion has a first passage for introducing the refrigerant from the condenser to the tank, a second passage for supplying the refrigerant from the tank to the evaporator and a third passage for transferring the refrigerant to the compressor from the evaporator, and wherein said head portion houses said expansion valve; and an adjusting mechanism and a control mechanism included in said expansion valve, wherein said adjusting mechanism is located in said second passage to adjust the flow rate of the refrigerant supplied to the evaporator from the tank, and wherein said control mechanism is located in said third passage to control said adjusting mechanism in accordance with the temperature of the refrigerant flowing in the third passage.

15. The receiver according to claim 14, wherein said synthetic resin includes polyphenylene sulfide.

16. The receiver according to claim 14, wherein said adjusting mechanism and said control mechanism are directly installed in said head portion.

17. The receiver according to claim 14, wherein said expansion valve has a housing for accommodating said adjusting mechanism and said control mechanism, wherein said head portion has a hole for receiving said housing, wherein said adjusting mechanism and said control mechanism are installed in the head portion when said housing is installed in the hole.

18. The receiver according to claim 14, wherein said adjusting mechanism has a restriction located in the second passage and a valve member for adjusting the size of the restriction, wherein said control mechanism has a sealed heat detecting chamber filled with gas, a diaphragm movable in accordance with the pressure in the detecting chamber and a transmitting member for transmitting the movement of the diaphragm to the valve member, and wherein heat of the refrigerant flowing in the third passage is transmitted to the gas in the detecting chamber.

19. The receiver according to claim 18, wherein said detecting chamber is located in said head portion such that it is adjacent to said third passage.

20. The receiver according to claim 18, wherein said detecting chamber projects from the head portion, and wherein said transmitting member extends across the third passage to transmit the heat of the refrigerant in the third passage to the gas in the detecting chamber.

21. The receiver according to claim 14 further comprising:

a first charging valve located in the head portion in the first passage to charge the refrigerant into the first passage;

a second charging valve located in the head portion in the third passage to charge the refrigerant into the third passage;

a relief valve located in the head portion in the second passage upstream of the adjusting mechanism, wherein said relief valve opens to release the refrigerant from the second passage when the pressure in the second passage upstream of the adjusting mechanism is higher than a predetermined level;

a sight glass located in the head portion in the second passage upstream of the adjusting mechanism, wherein said sight glass allows the refrigerant flowing in the second passage to be visually checked; and a pressure switch located in the head portion in the second passage upstream of the adjusting mechanism, wherein said pressure switch acts in accordance with the pressure in the second passage upstream of the adjusting mechanism.

* * * * *